US008168361B2

(12) United States Patent
Zhou et al.

(10) Patent No.: US 8,168,361 B2
(45) Date of Patent: May 1, 2012

(54) CURABLE TONER COMPOSITIONS AND PROCESSES

(75) Inventors: Ke Zhou, Oakville (CA); Daryl W. Vanbesien, Burlington, CA (US); Edward G. Zwartz, Mississauga, CA (US); Guerino G. Sacripante, Oakville, CA (US); Karen A. Moffat, Brantford, CA (US)

(73) Assignee: Xerox Corporation, Norwalk, CT (US)

( * ) Notice: Subject to any disclaimer, the term of this patent is extended or adjusted under 35 U.S.C. 154(b) by 292 days.

(21) Appl. No.: 12/579,801

(22) Filed: Oct. 15, 2009

(65) Prior Publication Data

US 2011/0091803 A1 Apr. 21, 2011

(51) Int. Cl.
*G03G 9/08* (2006.01)

(52) U.S. Cl. ..... 430/108.4; 430/109.4; 430/110.2; 430/137.14

(58) Field of Classification Search ..... 430/108.4, 430/109.4, 137.14, 110.2
See application file for complete search history.

(56) References Cited

U.S. PATENT DOCUMENTS

| | | | |
|---|---|---|---|
| 3,847,604 | A | 11/1974 | Hagenbach et al. |
| 4,338,390 | A | 7/1982 | Lu |
| 4,935,326 | A | 6/1990 | Creatura et al. |
| 4,937,166 | A | 6/1990 | Creatura et al. |
| 5,212,526 | A | 5/1993 | Domoto et al. |
| 5,278,020 | A | 1/1994 | Grushkin et al. |
| 5,290,654 | A | 3/1994 | Sacripante et al. |
| 5,308,734 | A | 5/1994 | Sacripante et al. |
| 5,344,738 | A | 9/1994 | Kmiecik-Lawrynowicz et al. |
| 5,346,797 | A | 9/1994 | Kmiecik-Lawrynowicz et al. |
| 5,348,832 | A | 9/1994 | Sacripante et al. |
| 5,364,729 | A | 11/1994 | Kmiecik-Lawrynowicz et al. |
| 5,366,841 | A | 11/1994 | Patel et al. |
| 5,370,963 | A | 12/1994 | Patel et al. |
| 5,403,693 | A | 4/1995 | Patel et al. |
| 5,405,728 | A | 4/1995 | Hopper et al. |
| 5,418,108 | A | 5/1995 | Kmiecik-Lawrynowicz et al. |
| 5,496,676 | A | 3/1996 | Croucher et al. |
| 5,501,935 | A | 3/1996 | Patel et al. |
| 5,527,658 | A | 6/1996 | Hopper et al. |
| 5,585,215 | A | 12/1996 | Ong et al. |
| 5,650,255 | A | 7/1997 | Ng et al. |
| 5,650,256 | A | 7/1997 | Veregin et al. |
| 5,723,253 | A | 3/1998 | Higashino et al. |
| 5,744,520 | A | 4/1998 | Kmiecik-Lawrynowicz et al. |
| 5,747,215 | A | 5/1998 | Ong et al. |
| 5,763,133 | A | 6/1998 | Ong et al. |
| 5,766,818 | A | 6/1998 | Smith et al. |
| 5,804,349 | A | 9/1998 | Ong et al. |
| 5,827,633 | A | 10/1998 | Ong et al. |
| 5,840,462 | A | 11/1998 | Foucher et al. |
| 5,853,944 | A | 12/1998 | Foucher et al. |
| 5,863,698 | A | 1/1999 | Patel et al. |
| 5,869,215 | A | 2/1999 | Ong et al. |
| 5,902,710 | A | 5/1999 | Ong et al. |
| 5,910,387 | A | 6/1999 | Mychajlowskij et al. |
| 5,916,725 | A | 6/1999 | Patel et al. |
| 5,919,595 | A | 7/1999 | Mychajlowskij et al. |
| 5,925,488 | A | 7/1999 | Patel et al. |
| 5,977,210 | A | 11/1999 | Patel et al. |
| 6,576,389 | B2 | 6/2003 | Vanbesien et al. |
| 6,608,987 | B2 | 8/2003 | Bartscher et al. |
| 6,617,092 | B1 | 9/2003 | Patel et al. |
| 6,627,373 | B1 | 9/2003 | Patel et al. |
| 6,638,677 | B2 | 10/2003 | Patel et al. |
| 6,653,041 | B2 | 11/2003 | Payne et al. |
| 6,656,657 | B2 | 12/2003 | Patel et al. |
| 6,656,658 | B2 | 12/2003 | Patel et al. |
| 6,664,017 | B1 | 12/2003 | Patel et al. |
| 6,665,516 | B2 | 12/2003 | Morgenweck et al. |
| 6,673,505 | B2 | 1/2004 | Jiang et al. |
| 6,713,222 | B2 | 3/2004 | Sacripante et al. |
| 6,730,450 | B1 | 5/2004 | Moffat et al. |
| 6,743,559 | B2 | 6/2004 | Combes et al. |
| 6,756,176 | B2 | 6/2004 | Stegamat et al. |
| 6,780,500 | B2 | 8/2004 | Dumouchel et al. |
| 6,830,860 | B2 | 12/2004 | Sacripante et al. |
| 6,837,839 | B2 | 1/2005 | Payne et al. |
| 6,880,463 | B2 | 4/2005 | De Meulemeester et al. |
| 7,029,817 | B2 | 4/2006 | Robinson et al. |
| 2003/0165766 | A1 * | 9/2003 | Zhang et al. ..... 430/124 |
| 2007/0292800 | A1 * | 12/2007 | Jin et al. ..... 430/137.1 |
| 2008/0107989 | A1 | 5/2008 | Sacripante et al. |

FOREIGN PATENT DOCUMENTS

| | | |
|---|---|---|
| GB | 1442835 | 7/1976 |

* cited by examiner

*Primary Examiner* — Mark A Chapman
(74) *Attorney, Agent, or Firm* — Oliff & Berridge, PLC

(57) ABSTRACT

An emulsion aggregation toner composition includes toner particles including: an amorphous polyester resin; an optional crystalline resin; an optional colorant; an optional wax; an optional coagulant; and a polymeric or oligomeric hydroxy ketone photo initiator capable of initiating crosslinking of said polyester resin, wherein at least one of the amorphous polyester resin and the optional crystalline resin when present is unsaturated.

20 Claims, No Drawings

CURABLE TONER COMPOSITIONS AND PROCESSES

TECHNICAL FIELD

This disclosure is generally directed to toner processes, and more specifically, emulsion aggregation and coalescence processes, as well as toner compositions formed by such processes and development processes using such toners. More specifically, this disclosure is directed to curable toner compositions, such as made by a chemical process such as emulsion aggregation, wherein the resultant toner composition comprises an amorphous polyester resin, an optional crystalline resin, a polymeric or oligomeric hydroxy ketone photo initiator, optionally a wax, and optionally a colorant, wherein at least one of the amorphous polyester resin and the optional crystalline resin when present is unsaturated. The process generally comprises aggregating latex particles, such as latexes containing an amorphous polyester resin, an optional crystalline resin, a photo initiator, optionally a wax, and optionally a colorant, in the presence of a coagulant. This disclosure is also directed to development processes using such a toner, where the formed image may be cured by ultraviolet light, with a conventional heated radiant or warm or cold pressure fusing.

BACKGROUND

Illustrated herein in embodiments are toner processes, and more specifically, emulsion aggregation and coalescence processes. More specifically, disclosed in embodiments are toner compositions and methods for the preparation of a curable toner compositions by a chemical process, such as emulsion aggregation, wherein latex particles, such as latexes containing unsaturated crystalline and/or amorphous polymeric particles such as polyester or sulfonated polyester, are aggregated with a photo initiator, optionally a wax, and optionally a colorant, in the presence of a coagulant such as a polymetal halide or other monovalent or divalent metal coagulants, and thereafter stabilizing the aggregates and coalescing or fusing the aggregates such as by heating the mixture above the resin Tg to provide toner size particles.

Also illustrated herein in embodiments are development processes using such a toner. For example, the toner can be used as a colored toner to print images that are subsequently fused, or the toner can be used as a clear overcoat toner and subsequently cured to provide protection to an underlying colored toner image. The curing, such as ultraviolet curing, can be conducted at the same time as conventional pressure or heated pressure fusing, or it can be conducted in a separate such as subsequent step. The ultraviolet curing desirably crosslinks the unsaturated resin in the toner composition to provide a robust image.

A number of advantages are associated with the toner obtained by the processes and toner compositions illustrated herein. The process allows for particles to be prepared in the size of 3 to 7 microns in diameter with narrow size distributions, such as from about 1.2 to about 1.25, without the use of classifiers. Furthermore, low melting or ultra-low melting fixing temperatures can be obtained by the use of crystalline resins in the toner composition. The aforementioned low fixing temperatures allows for the curing by ultraviolet light to occur at lower temperatures, such as from about 120 to about 135° C. The toner compositions provides improvements for other advantages, such as high temperature document offset properties, such as up to about 85° C., as well as resistance to organic solvents such as methyl ethyl ketone (MEK). This improved document offset means that printed images can withstand such higher temperatures during their lifetime, and can withstand the higher temperatures used in heat sealing processes.

REFERENCES

In U.S. Pat. No. 5,212,526, there is illustrated a process and apparatus for transferring and fusing an image to a recording medium, and wherein in an imaging process, a toned image layer on an image receptor is simultaneously transferred and fused to a recording medium. A radiation curable material is incorporated in the toned image layer such that when the toned image layer is irradiated, the radiation curable material is cured. The resulting cured material has greater adhesion to the toner material and the recording medium than to the surface of the image receptor. The apparatus for performing the above process is also disclosed. Similarly in U.S. Pat. No. 6,713,222, there is illustrated a process for crosslinking an image comprising applying ultraviolet light to an image comprised of a toner containing an unsaturated resin, photo initiator and colorant. Although, both of the aforementioned '526 and '222 patent, illustrates the curing of toner by Ultra-Violet light, the curing is done at elevated temperatures such as from about 160 to 185° C., additionally the toners are prepared by conventional melt extrusion, grinding and classification process. This differs from the present embodiments, wherein a chemical process such as Emulsion Aggregation is utilized to prepare the curable toner composition, and wherein smaller particles sizes such as 5 to 7 microns are prepared, with narrow size distribution such as 1.2 to 1.25 without classifying, and high yields such as 90 to 95% by weight are obtained. Furthermore, the present curable toner composition is comprised of a crystalline polyester component which enables low and ultra-low melt fixing, and wherein the toner composition is cured at lower temperature by ultra-violet light, such as from about 120 to 135° C., hence allowing for more economical energy efficient copier or printer.

Similarly, in U.S. Pat. No. 6,608,987, there is disclosed a method for printing and/or coating of a substrate, especially paper or cardboard, using at least one curable coating, comprising: at least one toner layer or an image having at least one toner layer is transferred to the substrate and fixed on it, the toner being a UV curable toner having at least one polymer that is exposed to UV (ultraviolet) radiation for crosslinking of its polymer chain, the degree of melting of the toner layer being fixed being controlled as a function of the desired luster. Other relevant prior art that describes similar toners composition which is cured when exposed to ultraviolet light are depicted in U.S. Pat. Nos. 6,665,516, 6,880,463, 6,837,839, and 6,653,041.

Emulsion aggregation/coalescing processes for the preparation of toners are illustrated in a number of Xerox patents, such as U.S. Pat. Nos. 5,290,654, 5,278,020, 5,308,734, 5,370,963, 5,344,738, 5,403,693, 5,418,108, 5,364,729, and 5,346,797; and also of interest may be U.S. Pat. Nos. 5,348,832; 5,405,728; 5,366,841; 5,496,676; 5,527,658; 5,585,215; 5,650,255; 5,650,256 5,501,935; 5,723,253; 5,744,520; 5,763,133; 5,766,818; 5,747,215; 5,827,633; 5,853,944; 5,804,349; 5,840,462; 5,869,215; 5,869,215; 5,863,698; 5,902,710; 5,910,387; 5,916,725; 5,919,595; 5,925,488 and 5,977,210. Other patents disclosing exemplary emulsion aggregation/coalescing processes include, for example, U.S. Pat. Nos. 6,730,450, 6,743,559, 6,756,176, 6,780,500, 6,830,860, and 7,029,817. Of particular interest is pending U.S. patent application Ser. No. 11/556,926 filed Nov. 6, 2006, in which there is disclosed an emulsion aggregation polyester toner comprised of an amorphous resin and a crystalline resin, wherein the toner has an acid value of from about 16 mg/eq. KOH to about 40 mg/eq. KOH, wherein the toner has a melting point of from about 50° C. to about 130° C., and wherein embodiments, comprises the process for making a latex by generating an emulsion of a polyester resin having an acid value of from about 16 mg/eq. KOH to about 40 mg/eq. KOH, by dissolving the polyester resin in an organic solvent, neutralizing the acid groups with an alkali base, dispersing in water followed by heating to remove the organic solvent, and optionally adding to the emulsion a colorant dispersion and/or a wax dispersion, shearing and adding an aqueous solution of acid until the pH of the mixture is from about 3 to about 5.5, heating to a temperature of from about 30° C. to 60° C., wherein the aggregate grows to a size of from about 3 to about 20 microns, raising the pH of the mixture to a range of about 7 to about 9, heating the mixture to about 60° C. to about 95° C., and optionally decreasing the pH to a range of 6.0 to 6.8 to coalesce the particles The disclosures of each of the foregoing patents and publications are hereby incorporated by reference herein in their entireties. The appropriate components and process aspects of the each of the foregoing patents and publications may also be selected for the present compositions and processes in embodiments thereof.

SUMMARY

Although various toner compositions are known, a problem remains in providing toner compositions that provide robust images, with little or no document offset, at elevated temperatures. For example, when toner images are used in printing automobile manuals, the resultant manuals are often kept in glove compartments in automobiles where the ambient temperature can exceed 50° C. on a regular basis. Likewise, when toner images are formed on products that are subsequently exposed to high temperatures, such as in heat sealing in the packaging industry, the toner image can also be exposed to temperatures in the 50 to 85° C. range or higher. Under these conditions, conventional toner compositions can soften, resulting in document offset and reduced image quality. This document offset can occur either between the printed side of one page and the unprinted side of an adjacent page, or between printed sides of two adjacent pages. Other useful applications where cured toner images are needed include book covers, postcards, photo-finish products, labels, car manuals, and packaging materials wherein abrasion free and scratch resistance are necessary.

A problem also remains that a photo initiator incorporated into the toner compositions should not adversely affect properties of the composition, and should desirably be an approved compound that would allow use of the toner compositions in such areas as food packaging and the like. For example, the photo initiator should not adversely affect the toner composition properties such as toner color, and should not result in a change, particularly a depression, of the resin glass transition temperature that could lead to blocking and/or cohesion problems. Furthermore, if the photo initiator is a governmentally approved material, such as approved by the U.S. Food and Drug Administration (FDA), then the toner composition can more likely be used for such applications as printing food packaging and the like.

This disclosure addresses these and other concerns by providing a toner composition that includes an unsaturated polyester resin, such as an unsaturated amorphous and/or crystalline polyester resin, and a polymeric or oligomeric hydroxy ketone photo initiator. When exposed to ultraviolet light, the polymeric or oligomeric hydroxy ketone photo initiator is activated to cause crosslinking of the polyester resin or resins, thereby providing a robust printed image with reduced document offset at elevated temperatures. At the same time, however, the photo initiator does not contribute any color effect to the composition, does not cause a change, such as depression, in the resin glass transition temperature, and is FDA approved for use on food packaging.

A toner composition and a process for preparing a toner including, for example, an emulsion aggregation process for preparing a toner, are described. The toner composition comprises, for example, an unsaturated polyester resin, a polymeric or oligomeric hydroxy ketone photo initiator, an optional colorant, an optional wax, and optionally a coagulant such as a monovalent metal, divalent metal, or polyion coagulant, wherein the toner is prepared by an emulsion aggregation process. The resin can be a crystalline or an amorphous resin, or a mixture thereof. In embodiments, the process for making the toner involves mixing an unsaturated polyester resin emulsion, a polymeric or oligomeric hydroxy ketone photo initiator, and an optional colorant dispersion and/or a wax dispersion, shearing and adding an aqueous solution of acid until the pH of the mixture is from about 4.0 to about 5.5, heating to a temperature below the Tg of the resin such as from about 30° C. to about 60° C., wherein the aggregate grows to a size of from about 3 to about 20 microns, raising the pH of the mixture to a range of about 7 to about 9, heating the mixture to a temperature above the Tg of the resin such as about 75° C. to about 95° C., optionally decreasing the pH to a range of about 6.0 to about 6.8, cooling the mixture, and optionally, isolating the toner. In other embodiments, the process for making the toner with a coagulant involves mixing an unsaturated polyester resin emulsion, a polymeric or oligomeric hydroxy ketone photo initiator, an optional colorant dispersion of from about 4 to about 25 percent by weight of toner, optionally a wax dispersion for example from about 5 to about 25 percent by weight of toner, and optionally a surfactant for example from about 0.1 to about 3 percent by weight of toner, and shearing with a homogenizer and adding an aqueous solution of acid, such as nitric acid, from about 0.01 to about 1 molar, until the pH of the mixture is, for example, from about 2.5 to about 4, followed by adding an aqueous solution of coagulant during homogenization and thereby generating an initial aggregate composite with a size for example of from about 1 to about 3 microns, heating to a temperature below the Tg of the resin such as from about 30° C. to about 60° C. and wherein the aggregate composite grows to a size for example of from about 3 to about 20 microns, such as from about 3 to about 11 microns, raising the pH of the mixture to a range of for example from about 7 to about 9 and heating the mixture to a temperature above the Tg of the resin such as from about 55° C. to about 95° C., optionally decreasing the pH to a range of for example from about 6.0 to about 6.8, cooling the mixture, and optionally, isolating the toner. The result is a colored or colorless toner composition that can be cured by ultraviolet irradiation.

In an embodiment, the present disclosure provides an emulsion aggregation toner composition comprising toner particles comprising:

an amorphous polyester resin;

an optional crystalline resin;

an optional colorant;

an optional wax;

an optional coagulant; and a polymeric or oligomeric hydroxy ketone photo initiator capable of initiating crosslinking of said polyester resin, wherein at least one of the amorphous polyester resin and the optional crystalline resin when present is unsaturated.

In an embodiment, the present disclosure provides a toner process comprising an emulsion aggregation process comprising;

(i) emulsifying a polyester resin and a photo initiator, wherein the polyester resin comprises an amorphous resin and optionally a crystalline resin, at least one of the amorphous polyester resin and the optional crystalline resin when present is unsaturated, and the photo initiator is a polymeric or oligomeric hydroxyl ketone photo initiator;

(ii) adding thereto a colorant dispersion, a polymeric or oligomeric hydroxy ketone photo initiator dispersion, optionally a wax dispersion, and surfactant;

(iii) adding thereto a coagulant to form a mixture, with homogenization of from about 2,000 to about 10,000 rpm, and optionally adjusting a pH of the mixture from about 7 to about 2.5, and thereby generating an aggregate mixture comprising aggregated composites of from about 1 to about 4 microns in diameter;

(iv) heating the aggregate mixture to a temperature of from about 30 to about 50° C. to generate aggregate composites with a particle size of from about 3 to about 11 microns in diameter;

(v) adjusting the pH to about 6 to about 9 to freeze the toner composite particle size, and optionally adding a metal sequestering agent;

(vi) heating the aggregate composites to a temperature of from about 63 to about 90° C., and optionally adjusting the pH to about 8 to about 5.5, to result in coalesced toner particles; and (vii) optionally washing and drying the toner particles.

In another embodiment, the present disclosure provides a method of developing an image, comprising:

applying a toner composition to a substrate, the toner composition comprising toner particles comprising an amorphous polyester resin, an optional crystalline resin, wherein at least one of the amorphous polyester resin and the optional crystalline resin when present is unsaturated, an optional colorant, an optional wax, an optional coagulant, and a polymeric or oligomeric hydroxy ketone photo initiator capable of initiating crosslinking of said polyester resin; and fusing the toner composition to the substrate by exposing said toner composition to an ultraviolet irradiation source that initiates crosslinking of said polyester resin.

EMBODIMENTS

The toner of the present disclosure is comprised of toner particles comprised of at least an amorphous polyester resin, an optional crystalline resin, a polymeric or oligomeric hydroxy ketone photo initiator, an optional wax, an optional colorant, and an optional coagulant. Beneficially, the toner of embodiments is curable by ultraviolet light to provide robust images with reduced document offset at elevated temperatures.

The specific resins selected for the toner of the present disclosure include polyester resins and/or its derivatives, including polyester resins and branched polyester resins, alkali sulfonated-polyester resins, branched alkali sulfonated-polyester resins, and crystalline polyester resins.

Illustrative examples of polymer resins selected for the process and particles of the present disclosure include any of the various polyesters, such as crystalline polyesters, amorphous polyesters, or a mixture thereof. The amorphous and crystalline polyester resin can be either saturated or unsaturated, as desired. However, at least one of the resins must contain some degree of unsaturation (C═C double bonds) so as to enable crosslinking of the resin by the photo initiator in the curing process. The degree of unsaturation can be any suitable degree to provide the desired degree or extent of crosslinking. Thus, for example, the toner particles can be comprised of crystalline polyester resins, amorphous polyester resins, or a mixture of two or more polyester resins where one or more polyester is crystalline and one or more polyester is amorphous.

Illustrative examples of crystalline polyester resins selected for the process and particles of the present disclosure include poly(ethylene-adipate), polypropylene-adipate), polybutylene-adipate), poly(pentylene-adipate), poly(hexylene-adipate), poly(octylene-adipate), polyethylene-succinate), polypropylene-succinate), poly(butylene-succinate), poly(pentylene-succinate), poly(hexylene-succinate), poly (octylene-succinate), poly(ethylene-sebacate), poly(propylene-sebacate), poly(butylene-sebacate), poly(pentylene-sebacate), poly(hexylene-sebacate), poly(octylene-sebacate), copoly(5-sulfoisophthaloyl)-copoly(ethylene-adipate), copoly(5-sulfoisophthaloyl)-copoly(propylene-adipate), copoly(5-sulfoisophthaloyl)-copoly(butylene-adipate), copoly(5-sulfo-isophthaloyl)-copoly(pentylene-adipate), copoly(5-sulfo-isophthaloyl)-copoly(hexylene-adipate), copoly(5-sulfo-isophthaloyl)-copoly(octylene-adipate), copoly(5-sulfo-isophthaloyl)-copoly(ethylene-adipate), copoly(5-sulfo-isophthaloyl)-copoly(propylene-adipate), copoly(5-sulfo-isophthaloyl)-copoly(butylene-adipate), copoly(5-sulfo-isophthaloyl)-copoly(pentylene-adipate), copoly(5-sulfo-isophthaloyl)-copoly(hexylene-adipate), copoly(5-sulfo-isophthaloyl)-copoly(octylene-adipate), copoly(5-sulfoisophthaloyl)-copoly(ethylene-succinate), copoly(5-sulfoisophthaloyl)-copoly(propylene-succinate), copoly(5-sulfoisophthaloyl)-copoly(butylene-succinate), copoly(5-sulfoisophthaloyl)-copoly(pentylene-succinate), copoly(5-sulfoisophthaloyl)-copoly(hexylene-succinate), copoly(5-sulfoisophthaloyl)-copoly(octylene-succinate), copoly(5-sulfo-isophthaloyl)-copoly(ethylene-sebacate), copoly(5-sulfo-isophthaloyl)-copoly(propylene-sebacate), copoly(5-sulfo-isophthaloyl)-copoly(butylenes-sebacate), copoly(5-sulfo-isophthaloyl)-copoly(pentylene-sebacate), copoly(5-sulfo-isophthaloyl)-copoly(hexylene-sebacate), copoly(5-sulfo-isophthaloyl)-copoly(octylene-sebacate), copoly(5-sulfo-isophthaloyl)-copoly(ethylene-adipate), copoly(5-sulfo-isophthaloyl)-copoly(propylene-adipate), copoly(5-sulfo-isophthaloyl)-copoly(butylene-adipate), copoly(5-sulfo-isophthaloyl)-copoly(pentylene-adipate), copoly(5-sulfo-isophthaloyl)-copoly(hexylene-adipate), poly(octylene-adipate) and unsaturated copolyesters such as copoly(ethylene-sebacate)-copoly(ethylene-fumarate), copoly(ethylene-dodecanoate)-copoly(ethylene-fumarate), copoly(nonylene-sebacate)-copoly(nonylene-fumarate), copoly(nonylene-dodecanoate)-copoly(nonylene-fumarate), copoly(decylene-sebacate)-copoly(decylene-fumarate), or copoly(decylene-dodecanoate)-copoly(decylene-fumarate), copoly(butylene-fumarate)-copoly(hexylene-fumarate) and the like.

The crystalline resins, which are available from a number of sources, can possess various melting points of from about 30° C. to about 120° C., or from about 50° C. to about 90° C. The crystalline resin may have a number average molecular weight (Mn), as measured by gel permeation chromatography (GPC) of, for example, from about 1,000 to about 50,000, or from about 2,000 to about 25,000. The weight average molecular weight (Mw) of the resin may be, for example, from about 2,000 to about 100,000, or from about 3,000 to about 80,000, as determined by GPC using polystyrene standards. The molecular weight distribution (Mw/Mn) of the crystalline resin can be from about 2 to about 6, or from about 2 to about 4.

The crystalline resins can be prepared by a polycondensation process by reacting suitable organic diol(s) and suitable organic diacid(s) in the presence of a polycondensation catalyst. Generally, a stoichiometric equimolar ratio of organic diol and organic diacid is utilized, however, in some instances, wherein the boiling point of the organic diol is from about 180° C. to about 230° C., an excess amount of diol can be utilized and removed during the polycondensation process. The amount of catalyst utilized varies, and can be selected in an amount, for example, of from about 0.01 to about 1 mole percent of the resin. Additionally, in place of the organic diacid, an organic diester can also be selected, and where an alcohol byproduct is generated.

Examples of organic diols include aliphatic diols with from about 2 to about 36 carbon atoms, such as 1,2-ethanedial, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, and the like; alkali sulfo-aliphatic diols such as sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixture thereof, and the like. The aliphatic dial is, for example, selected in an amount of from about 45 to about 50 mole percent of the resin, and the alkali sulfo-aliphatic dial can be selected in an amount of from about 1 to about 10 mole percent of the resin.

Examples of organic diacids or diesters selected for the preparation of the crystalline polyester resins include fumaric, maleic, oxalic acid, succinic acid, glutaric acid, adipic acid, suberic acid, azelaic acid, sebacic acid, phthalic acid, isophthalic acid, terephthalic acid, napthalene-2,6-dicarboxylic acid, naphthalene-2,7-dicarboxylic acid, cyclohexane dicarboxylic acid, malonic acid and mesaconic acid, a diester or anhydride thereof; and an alkali sulfo-organic diacid such as the sodio, lithio or potassium salt of dimethyl-5-sulfo-isophthalate, dialkyl-5-sulfo-isophthalate-4-sulfo-1,8-naphthalic anhydride, 4-sulfo-phthalic acid, dimethyl-4-sulfo-phthalate, dialkyl-4-sulfo-phthalate, 4-sulfophenyl-3,5-dicarbomethoxybenzene, 6-sulfo-2-naphthyl-3,5-dicarbomethoxybenzene, sulfo-terephthalic acid, dimethyl-sulfo-terephthalate, 5-sulfo-isophthalic acid, dialkyl-sulfo-terephthalate, sulfoethanediol, 2-sulfopropanediol, 2-sulfobutanediol, 3-sulfopentanediol, 2-sulfohexanediol, 3-sulfo-2-methyl-pentanediol, 2-sulfo-3,3-dimethylpentanediol, sulfo-p-hydroxybenzoic acid, N,N-bis(2-hydroxyethyl)-2-amino ethane sulfonate, or mixtures thereof. The organic diacid is selected in an amount of, for example, from about 40 to about 50 mole percent of the resin, and the alkali sulfoaliphatic diacid can be selected in an amount of from about 1 to about 10 mole percent of the resin.

Illustrative examples of amorphous polyester resins selected for the process and particles of the present disclosure include any of the various amorphous polyesters, such as SPAR™ (Dixie Chemicals), BECKOSOL™ (Reichhold Inc), ARAKOTE™ (Ciba-Geigy Corporation), HETRON™ (Ashland Chemical), PARAPLEX™ (Rohm & Hass), POLYLITE™ (Reichhold Inc), PLASTHALL™ (Rohm & Hass), CYGAL™ (American Cyanamide), ARMCO™ (Armco Composites), ARPOL™ (Ashland Chemical), CELANEX™ (Celanese Eng), RYNITE™ (DuPont), STYPOL™ (Freeman Chemical Corporation) mixtures thereof and the like. The resins can also be functionalized, such as carboxylated, sulfonated, or the like, and particularly such as sodio sulfonated, if desired.

The amorphous resins, linear or branched, saturated or unsaturated which are available from a number of sources, can possess various onset Tg's of, for example, from about 40° C. to about 80° C., such as from about 50° C. to about 70° C. as measured by differential scanning calorimetry (DSC). The linear or branched saturated or unsaturated amorphous polyester resins, in embodiments, possess, for example, a number average molecular weight (Mn), as measured by GPC, of from about 10,000 to about 500,000, or about 5,000 to about 250,000; a weight average molecular weight (Mw) of from about 20,000 to about 600,000, or from about 7,000 to about 300,000, as determined by GPC using polystyrene standards; and a molecular weight distribution (Mw/Mn) of from about 1.5 to about 6, or from about 2 to about 4.

The linear saturated and/or non-saturated amorphous polyester resins are generally prepared by the polycondensation of an organic diol, a diacid or diester, and a polycondensation catalyst. For the branched amorphous sulfonated polyester resin, the same materials may be used, with the further inclusion of a branching agent such as a multivalent polyacid or polyol. The amorphous resin is generally present in the toner composition in various suitable amounts, such as from about 60 to about 90 weight percent, or from about 50 to about 65 weight percent, of the toner or of the solids.

Examples of diacid or diesters selected for the preparation of amorphous saturated and/or non-saturated polyesters include dicarboxylic acids or diesters selected from the group consisting of terephthalic acid, phthalic acid, isophthalic acid, fumaric acid, maleic acid, itaconic acid, succinic acid, succinic anhydride, dodecylsuccinic acid, dodecylsuccinic anhydride, glutaric acid, glutaric anhydride, adipic acid, pimelic acid, suberic acid, azelic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and mixtures thereof. The organic diacid or diester is selected, for example, from about 45 to about 52 mole percent of the resin. Examples of diols utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol, A, 1,4-cyclohexanedimethanol, 1,3-cyclohexanedimethanol, xylenedimethanol, cyclohexanediol, diethylene glycol, bis(2-hydroxyethyl) oxide, dipropylene glycol, dibutylene, and mixtures thereof. The amount of organic diol selected can vary, and more specifically, is, for example, from about 45 to about 52 mole percent of the resin.

Branching agents for use in forming the branched amorphous sulfonated or non-sulfonated saturated or non-saturated polyester include, for example, a multivalent polyacid such as 1,2,4-benzene-tricarboxylic acid, 1,2,4-cyclohexanetricarboxylic acid, 2,5,7-naphthalenetricarboxylic acid, 1,2,4-naphthalenetricarboxylic acid, 1,2,5-hexanetricarboxylic acid, 1,3-dicarboxyl-2-methyl-2-methylene-carboxylpropane, tetra(methylene-carboxyl)methane, and 1,2,7,8-octanetetracarboxylic acid, acid anhydrides thereof, and lower alkyl esters thereof, 1 to about 6 carbon atoms; a multivalent polyol such as sorbitol, 1,2,3,6-hexanetetrol, 1,4-sorbitane, pentaerythritol, dipentaerythritol, tripentaerythritol, sucrose, 1,2,4-butanetriol, 1,2,5-pentatriol, glycerol, 2-methylpropanetriol, 2-methyl-1,2,4-butanetriol, trimethylolethane, trimethylolpropane, 1,3,5-trihydroxymethylbenzene, mixtures thereof, and the like. The branching agent amount selected is, for example, from about 0.1 to about 5 mole percent of the resin.

Examples of suitable polycondensation catalyst for either the crystalline or amorphous polyesters include tetraalkyl titanates, dialkyltin oxide such as dibutyltin oxide, tetraalkyltin such as dibutyltin dilaurate, dialkyltin oxide hydroxide such as butyltin oxide hydroxide, aluminum alkoxides, alkyl zinc, dialkyl zinc, zinc oxide, stannous oxide, or mixtures thereof; and which catalysts are selected in amounts of, for example, from about 0.01 mole percent to about 5 mole percent based on the starting diacid or diester used to generate the polyester resin.

The polymer resin may be present in an amount of from about 65 to about 95 percent by weight, or from about 75 to about 85 percent by weight of the toner particles (that is, toner particles exclusive of external additives) on a solids basis. The ratio of crystalline resin to amorphous resin can be in the range from about 1:99 to about 30:70, such as from about 5:95 to about 25:75. However, amounts and ratios outside of these ranges can be used, in embodiments, depending upon the type and amounts of other materials present.

It has also been found that a polymer with a low acid number provides better crosslinking results under irradiation. For example, it is desired in embodiments that the acid number of the polymer be from about 0 to about 40, or from 0 to about 25 or to about 30 or from 0 to about 16 or about 5 to about 10 or to about 15 mg KOH/g.

To enable curing of the unsaturated polymer, the toners of the present disclosure also contain a photo initiator. The photo initiator in embodiments is a polymeric or oligomeric hydroxy ketone photo initiator. It has been found that such photo initiators provide surprising results of not altering the coloristic properties of the toner particles (not affecting the toner color), and not depressing the glass transition temperature of the resin that may lead to blocking or cohesion problems, contrary to results that are provided by other photo initiators. Furthermore, some or all of the polymeric or oligomeric hydroxy ketone photo initiators are safe for such applications as food packaging and the like, as they are FDA approved. Examples of suitable polymeric or oligomeric hydroxy ketone photo initiators include oligo[2-hydroxy-2-methyl-1-[4-1 methylvinyl)phenyl]propanone] compounds of the formula

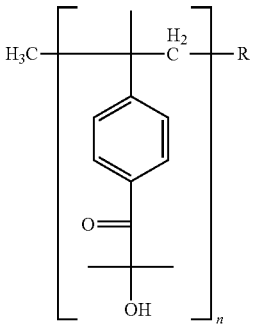

where R is H, $CH_3$ or an alkyl radical represented by $C_nH_{2n+1}$ in which n is a positive integer from 2 to about 1000. Commercial examples of such polymeric or oligomeric hydroxy ketone photo initiators include the ESACURE® photo initiators available from Lamberti (Sartomer) Company, Inc., such as ESACURE® One series (Esacure One 75, Esacure one 65) and the ESACURE® KIP series (KIP 150, KIP 75LT, KIP IT, KIP 100 F). Mixtures of two or more such polymeric or oligomeric hydroxy ketone photo initiators, or one or more polymeric or oligomeric hydroxy ketone photo initiator and one or more conventional photo initiator, can also be used.

In embodiments, the photo initiator exhibits an absorption peak of about 260 nm in methanol.

In embodiments, the toner composition contains from about 0.1 to about 15 wt % photo initiator, or from about 0.5 to about 15 wt %, or from about 0.5 to about 12 wt %, photoinitiator.

In addition to the polymer binder resin and photo initiator, the toners of the present disclosure also optionally contain a wax, which can be either a single type of wax or a mixture of two or more different waxes. A single wax can be added to toner formulations, for example, to improve particular toner properties, such as toner particle shape, presence and amount of wax on the toner particle surface, charging and/or fusing characteristics, gloss, stripping, offset properties, and the like. Alternatively, a combination of waxes can be added to provide multiple properties to the toner composition.

Suitable examples of waxes include waxes selected from natural vegetable waxes, natural animal waxes, mineral waxes, synthetic waxes and functionalized waxes. Examples of natural vegetable waxes include, for example, carnauba wax, candelilla wax, Japan wax, and bayberry wax. Examples of natural animal waxes include, for example, beeswax, panic wax, lanolin, lac wax, shellac wax, and spermaceti wax. Mineral waxes include, for example, paraffin wax, microcrystalline wax, montan wax, ozokerite wax, ceresin wax, petrolatum wax, and petroleum wax. Synthetic waxes include, for example, Fischer-Tropsch wax, acrylate wax, fatty acid amide wax, silicone wax, polytetrafluoroethylene wax, polyethylene wax, and polypropylene wax, and mixtures thereof.

Examples of waxes of embodiments include polypropylenes and polyethylenes commercially available from Allied Chemical and Baker Petrolite, wax emulsions available from Michelman Inc. and the Daniels Products Company, EPOLENE N-15 commercially available from Eastman Chemical Products, Inc., VISCOL 550-P, a low weight average molecular weight polypropylene available from Sanyo Kasei K.K., and similar materials. The commercially available polyethylenes usually possess a molecular weight Mw of from about 1,000 to about 1,500, while the commercially available polypropylenes utilized have a molecular weight of about 4,000 to about 5,000. Examples of functionalized waxes include amines, amides, imides, esters, quaternary amines, carboxylic acids or acrylic polymer emulsion, for example, JONCRYL 74, 89, 130, 537, and 538, all available from Johnson Diversey, Inc., chlorinated polypropylenes and polyethylenes commercially available from Allied Chemical and Petrolite Corporation and Johnson Diversey, Inc. Many of the polyethylene and polypropylene compositions useful in embodiments are illustrated in British Pat. No. 1,442,835, the entire disclosure of which is incorporated herein by reference.

The toners may contain the wax in any amount of from, for example, about 3 to about 15 percent by weight of the toner, on a dry basis or from about 5 to about 11 percent by weight of the wax.

For conventional emulsion aggregation processes, the resin latex or emulsion can be prepared by any suitable means. For example, the latex or emulsion is prepared by taking the resin and heating it to its melting temperature and dispersing the resin in an aqueous phase containing a surfactant. The dispersion is carried out by various dispersing equipment such as an ultimizer, high speed homogenizer, or the like to provide submicron resin particles (particles having an average diameter or particle size of less than about 1 micron). Other ways to prepare the resin latex or emulsion include solubilizing the resin in a solvent and adding it to heated water to flash evaporate the solvent. External dispersions have also been employed to assist the formation of emulsion as the solvent is being evaporated. Likewise, to incorporate the wax into the toner, if a wax is included, the wax can be in the form of one or more aqueous emulsions or dispersions of solid wax in water, where the solid wax particle size is usually in the range of from about 100 to about 300 nm.

The toners also may optionally contain at least one colorant. In embodiments where the toner composition is used as an overcoat, for example to protect an underlying toner image, the toner composition desirably does not include a colorant and thus is clear and colorless. When used as such an overcoat, the toner composition may variously be applied to an entire surface of an imaging substrate (such as a sheet of paper), or it may be applied to only a portion of the imaging substrate, such as only over an already applied toner image. However, in embodiments where the toner composition is used to form a visible toner image, the toner composition desirably does include one or more desired colorants.

For example, colorants or pigments as used herein include pigment, dye, mixtures of pigment and dye, mixtures of pigments, mixtures of dyes, and the like. For simplicity, the term "colorant" as used herein is meant to encompass such colorants, dyes, pigments, and mixtures, unless specified as a particular pigment or other colorant component. In embodiments, the colorant comprises a pigment, a dye, mixtures thereof, carbon black, magnetite, black, cyan, magenta, yellow, red, green, blue, brown, mixtures thereof, in an amount of about 1 percent to about 25 percent by weight based upon the total weight of the composition. It is to be understood that other useful colorants will become readily apparent based on the present disclosures.

In general, useful colorants include Paliogen Violet 5100 and 5890 (BASF), Normandy Magenta RD-2400 (Paul Uhlrich), Permanent Violet VT2645 (Paul Uhlrich), Heliogen Green L8730 (BASF), Argyle Green XP-111-S (Paul Uhlrich), Brilliant Green Toner GR 0991 (Paul Uhlrich), Lithol Scarlet D3700 (BASF), Toluidine Red (Aldrich), Scarlet for Thermoplast NSD Red (Aldrich), Lithol Rubine Toner (Paul Uhlrich), Lithol Scarlet 4440, NBD 3700 (BASF), Bon Red C (Dominion Color), Royal Brilliant Red RD-8192 (Paul Uhlrich), Oracet Pink RF (Ciba Geigy), Paliogen Red 3340 and 3871K (BASF), Lithol Fast Scarlet L4300 (BASF), Heliogen Blue D6840, D7080, K7090, K6910 and L7020 (BASF), Sudan Blue OS (BASF), Neopen Blue FF4012 (BASF), PV Fast Blue B2G01 (American Hoechst), Irgalite Blue BCA (Ciba Geigy), Paliogen Blue 6470 (BASE), Sudan II, III and IV (Matheson, Coleman, Bell), Sudan Orange (Aldrich), Sudan Orange 220 (BASF), Paliogen Orange 3040 (BASF), Ortho Orange OR 2673 (Paul Uhlrich), Paliogen Yellow 152 and 1560 (BASF), Lithol Fast Yellow 0991K (BASF), Paliotol Yellow 1840 (BASF), Novaperm Yellow FGL (Hoechst), Permanerit Yellow YE 0305 (Paul Uhlrich), Lumogen Yellow D0790 (BASF), Suco-Gelb 1250 (BASF), Suco-Yellow D1355 (BASF), Suco Fast Yellow D1165, D1355 and D1351 (BASF), Hostaperm Pink E (Hoechst), Fanal Pink D4830 (BASF), Cinquasia Magenta (DuPont), Paliogen Black L9984 9BASF), Pigment Black K801 (BASF) and particularly carbon blacks such as REGAL 330 (Cabot), Carbon Black 5250 and 5750 (Columbian Chemicals), and the like or mixtures thereof Additional useful colorants include pigments in water based dispersions such as those commercially available from Sun Chemical, for example SUNSPERSE BHD 6011X (Blue 15 Type), SUNSPERSE BHD 9312X (Pigment Blue 15 74160), SUNSPERSE BHD 6000X (Pigment Blue 15:3 74160), SUNSPERSE GHD 9600X and GHD 6004X (Pigment Green 7 74260), SUNSPERSE QHD 6040X (Pigment Red 122 73915), SUNSPERSE RHD 9668X (Pigment Red 185 12516), SUNSPERSE RHD 9365X and 9504X (Pigment Red 57 15850:1, SUNSPERSE YHD 6005X (Pigment Yellow 83 21108), FLEXIVERSE YFD 4249 (Pigment Yellow 17 21105), SUNSPERSE YHD 6020X and 6045X (Pigment Yellow 74 11741), SUNSPERSE YHD 600X and 9604X (Pigment Yellow 14 21095), FLEXIVERSE LFD 4343 and LED 9736 (Pigment Black 7 77226) and the like or mixtures thereof. Other useful water based colorant dispersions include those commercially available from Clariant, for example, HOSTAFINE Yellow GR, HOSTAFINE Black T and Black TS, HOSTAFINE Blue B2G, HOSTAFINE Rubine F6B and magenta thy pigment such as Toner Magenta 6BVP2213 and Toner Magenta B02 which can be dispersed in water and/or surfactant prior to use.

Other useful colorants include, for example, magnetites, such as Mobay magnetites M08029, M08960; Columbian magnetites, MAPICO BLACKS and surface treated magnetites; Pfizer magnetites CB4799, CB5300, CB5600, MCX6369; Bayer magnetites, BAYFERROX 8600, 8610; Northern Pigments magnetites, NP-604, NP-608; Magnox magnetites TMB-100 or TMB-104; and the like or mixtures thereof. Specific additional examples of pigments include phthalocyanine HELIOGEN BLUE L6900, D6840, D7080, D7020, PYLAM OIL BLUE, PYLAM OIL YELLOW, PIGMENT BLUE 1 available from Paul Uhlrich & Company, Inc., PIGMENT VIOLET 1, PIGMENT RED 48, LEMON CHROME YELLOW DCC 1026, E.D. TOLUIDINE RED and BON RED C available from Dominion Color Corporation, Ltd., Toronto, Ontario, NOVAPERM YELLOW FGL, HOSTAPERM PINK E from Hoechst, and CINQUASIA MAGENTA available from E.I. DuPont de Nemours & Company, and the like. Examples of magentas include, for example, 2,9-dimethyl substituted quinacridone and anthraquinone dye identified in the Color Index as CI 60710, CI Dispersed Red 15, diazo dye identified in the Color Index as CI 26050, CI Solvent Red 19, and the like or mixtures thereof. Illustrative examples of cyans include copper tetra (octadecyl sulfonamide) phthalocyanine, x-copper phthalocyanine pigment listed in the Color Index as CI74160, CI Pigment Blue, and Anthrathrene Blue identified in the Color Index as DI 69810, Special Blue X-2137, and the like or mixtures thereof. Illustrative examples of yellows that may be selected include diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,4-dimethoxy acetoacetanilide, and Permanent Yellow FGL. Colored magnetites, such as mixtures of MAPICOBLACK and cyan components may also be selected as pigments.

The colorant, such as carbon black, cyan, magenta and/or yellow colorant, is incorporated in an amount sufficient to impart the desired color to the toner. In general, pigment or dye is employed in an amount ranging from about 1 to about 35 percent by weight of the toner particles on a solids basis, such as from about 5 to about 25 percent by weight or from about 5 to about 15 percent by weight. However, amounts outside these ranges can also be used, in embodiments.

The toners of the present disclosure may also contain a coagulant, such as a monovalent metal coagulant, a divalent metal coagulant, a polyion coagulant, or the like. A variety of coagulants are known in the art, as described above. As used herein, "polyion coagulant" refers to a coagulant that is a salt or oxide, such as a metal salt or metal oxide, formed from a metal species having a valence of at least 3, and desirably at least 4 or 5. Suitable coagulants thus include, for example, coagulants based on aluminum such as polyaluminum halides such as polyaluminum fluoride and polyaluminum chloride (PAC), polyaluminum silicates such as polyaluminum sulfosilicate (PASS), polyaluminum hydroxide, polyaluminum phosphate, aluminum sulfate, and the like. Other suitable coagulants include, but are not limited to, tetraalkyl titinates, dialkyltin oxide, tetraalkyltin oxide hydroxide, dialkyltin oxide hydroxide, aluminum alkoxides, alkylzinc, dialkyl zinc, zinc oxides, stannous oxide, dibutyltin oxide, dibutyltin oxide hydroxide, tetraalkyl tin, and the like. Where the coagulant is a polyion coagulant, the coagulants may have any desired number of polyion atoms present. For example, suitable polyaluminum compounds in embodiments have from about 2 to about 13, such as from about 3 to about 8, aluminum ions present in the compound Such coagulants can be incorporated into the toner particles during particle aggregation. As such, the coagulant can be present in the toner particles, exclusive of external additives and on a dry weight basis, in amounts of from 0 to about 5 percent by weight of the toner particles, such as from about greater than 0 to about 3 percent by weight of the toner particles.

The toner may also include additional known positive or negative charge additives in effective suitable amounts of from about 0.1 to about 5 weight percent of the toner, such as quaternary ammonium compounds inclusive of alkyl pyridinium halides, bisulfates, organic sulfate and sulfonate compositions such as disclosed in U.S. Pat. No. 4,338,390, cetyl pyridinium tetrafluoroborates, distearyl dimethyl ammonium methyl sulfate, aluminum salts or complexes, and the like.

Also, in preparing the toner by the emulsion aggregation procedure, one or more surfactants may be used in the process. Suitable surfactants include anionic, cationic and nonionic surfactants. In embodiments, the use of anionic and nonionic surfactants helps stabilize the aggregation process in the presence of the coagulant, which otherwise could lead to aggregation instability.

Anionic surfactants include sodium dodecylsulfate (SDS), sodium dodecyl benzene sulfonate, sodium dodecylnaphthalene sulfate, dialkyl benzenealkyl, sulfates and sulfonates, abitic acid, and the NEOGEN brand of anionic surfactants. An example of a suitable anionic surfactant is NEOGEN RK available from Daiichi Kogyo Seiyaku Co. Ltd., or TAYCA POWER BN2060 from Tayca Corporation (Japan), which consists primarily of branched sodium dodecyl benzene sulphonate.

Examples of cationic surfactants include dialkyl benzene alkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecyl benzyl triethyl ammonium chloride, MIRAPOL and ALKAQUAT available from Alkaril Chemical Company, SANISOL (benzalkonium chloride), available from Kao Chemicals, and the like. An example of a suitable cationic surfactant is SANISOL B-50 available from Kao Corp., which consists primarily of benzyl dimethyl alkonium chloride.

Examples of nonionic surfactants include polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenc Inc. as IGEPAL CA-210, IGEPAL CA-520, IGEPAL CA-720, IGEPAL CO-890, IGEPAL CO-720, IGEPAL CO-290, IGEPAL CA-210, ANTAROX 890 and ANTAROX 897. An example of a suitable nonionic surfactant is ANTAROX 897 available from Rhone-Poulenc Inc., which consists primarily of alkyl phenol ethoxylate.

Examples of bases used to increase the pH and hence ionize the aggregate particles thereby providing stability and preventing the aggregates from growing in size can be selected from sodium hydroxide, potassium hydroxide, ammonium hydroxide, cesium hydroxide and the like, among others.

Examples of the acids that can be utilized include, for example, nitric acid, sulfuric acid, hydrochloric acid, acetic acid, citric acid, trifluoro acetic acid, succinic acid, salicylic acid and the like, and which acids are in embodiments utilized in a diluted form in the range of about 0.5 to about 10 weight percent by weight of water or in the range of about 0.7 to about 5 weight percent by weight of water.

Any suitable emulsion aggregation procedure may be used in forming the emulsion aggregation toner particles without restriction. These procedures typically include the basic process steps of at least aggregating an emulsion containing polymer binder and one or more optional waxes, one or more optional colorants, one or more surfactants, an optional coagulant, and one or more additional optional additives to form aggregates, subsequently coalescing or fusing the aggregates, and then recovering, optionally washing and optionally drying the obtained emulsion aggregation toner particles. However, in embodiments, the process further includes a photo initiator in the aggregation step.

Suitable emulsion aggregation/coalescing processes for the preparation of toners, and which can be modified to include the photo initiator as described herein, are illustrated in a number of Xerox patents, the disclosures of each of which are totally incorporated herein by reference, such as U.S. Pat. Nos. 5,290,654, 5,278,020, 5,308,734, 5,370,963, 5,344,738, 5,403,693, 5,418,108, 5,364,729, and 5,346,797. Also of interest are U.S. Pat. Nos. 5,348,832; 5,405,728; 5,366,841; 5,496,676; 5,527,658; 5,585,215; 5,650,255; 5,650,256; 5,501,935; 5,723,253; 5,744,520; 5,763,133; 5,766,818; 5,747,215; 5,827,633; 5,853,944; 5,804,349; 5,840,462; 5,869,215; 5,863,698; 5,902,710; 5,910,387; 5,916,725; 5,919,595; 5,925,488; and 5,977,210, the disclosures of each of which are hereby totally incorporated herein by reference. In addition, Xerox U.S. Pat. Nos. 6,627,373; 6,656,657; 6,617,092; 6,638,677; 6,576,389; 6,664,017; 6,656,658; and 6,673,505 are each hereby totally incorporated herein by reference. The appropriate components and process aspects of each of the foregoing U.S. patents may be selected for the present composition and process in embodiments thereof.

In embodiments hereof, the toner process comprises forming a toner particle by mixing the polymer latex, in the presence of a photo initiator, an optional wax and an optional colorant dispersion to which is added an optional coagulant while blending at high speeds such as with a polytron. The resulting mixture having a pH of, for example, about 2 to about 4.5 is aggregated by heating to a temperature below the polymer resin Tg to provide toner size aggregates. Optionally, additional latex can be added to the formed aggregates providing a shell over the formed aggregates. The pH of the mixture is then changed, for example by the addition of a sodium hydroxide solution until a pH of about 7.0 is achieved, and optionally a metal sequestering agent such as tetrasodium ethylene diamine tetracetate. The temperature of the mixture is then raised to above the resin Tg, such as to about 95° C. After about 30 minutes, the pH of the mixture is reduced to a value sufficient to coalesce or fuse the aggregates to provide a composite particle upon further heating such as about 5.5 to about 6.5. The fused particles can be measured for shape factor or circularity, such as with a Sysmex FPIA 2100 analyzer, until the desired shape is achieved.

The mixture is allowed to cool to room temperature (about 20° C. to about 25° C.) and is optionally washed to remove the surfactant. The toner is then optionally dried.

The toner particles of the present disclosure can be made to have the following physical properties when no external additives are present on the toner particles.

The toner particles can have a surface area, as measured by the well known BET method, of about 1.3 to about 6.5 $m^2/g$. For example, for cyan, yellow and black toner particles, the BET surface area can be less than 2 $m^2/g$, such as from about 1.4 to about 1.8 $m^2/g$, and for magenta toner, from about 1.4 to about 6.3 $m^2/g$.

It is also desirable to control the toner particle size and limit the amount of both fine and coarse toner particles in the toner. In an embodiment, the toner particles have a very narrow particle size distribution with a lower number ratio geometric standard deviation (GSD) of approximately 1.15 to approximately 1.40, or approximately less than 1.35. The toner particles of the present disclosure also can have a size such that the upper geometric standard deviation (GSD) by volume is in the range of from about 1.15 to about 1.35, such as from about 1.16 to about 1.30, or less than 1.25. These GSD values for the toner particles of the present disclosure indicate that the toner particles are made to have a very narrow particle size distribution.

Shape factor is also a control process parameter associated with the toner being able to achieve optimal machine performance. The toner particles can have a shape factor of about 105 to about 170, such as about 110 to about 160, SF1*a. Scanning electron microscopy (SEM) is used to determine the shape factor analysis of the toners by SEM and image analysis (IA) is tested. The average particle shapes are quantified by employing the following shape factor (SF1*a) formula: $SF1*a=100\pi d^2/(4A)$, where A is the area of the particle and d is its major axis. A perfectly circular or spherical particle has a shape factor of exactly 100. The shape factor SF1*a increases as the shape becomes more irregular or elongated in shape with a higher surface area. In addition to measuring shape factor SF, another metric to measure particle circularity is being used on a regular basis. This is a faster method to quantify the particle shape. The instrument used is an FPIA-2100 manufactured by Sysmex. For a completely circular sphere the circularity would be 1.000. The toner particles can have circularity of about 0.920 to 0.990 and, such as from about 0.940 to about 0.985.

It is desirable in embodiments that the toner particle has separate crystalline polyester and wax melting points and amorphous polyester glass transition temperature as measured by DSC, and that the melting temperatures and glass transition temperature are not substantially depressed by plastification of the amorphous or crystalline polyesters, or by the photo initiator, or by the wax. To achieve non-plasticization, it is ideal to practice the emulsion aggregation at a coalescence temperature of less than the melting point of the crystalline component, photo initiator and wax components.

The toner particles can be blended with external additives following formation. Any suitable surface additives may be used in embodiments. Most suitable are one or more of $SiO_2$, metal oxides such as, for example, $TiO_2$ and aluminum oxide, and a lubricating agent such as, for example, a metal salt of a fatty acid (e.g., zinc stearate (ZnSt), calcium stearate) or long chain alcohols such as UNILIN 700, as external surface additives. In general, silica is applied to the toner surface for toner flow, tribo enhancement, admix control, improved development and transfer stability and higher toner blocking temperature. $TiO_2$ is applied for improved relative humidity (RH) stability, tribo control and improved development and transfer stability. Zinc stearate is optionally also used as an external additive for the toners of the disclosure, the zinc stearate providing lubricating properties. Zinc stearate provides developer conductivity and tribo enhancement, both due to its lubricating nature. In addition, zinc stearate enables higher toner charge and charge stability by increasing the number of contacts between toner and carrier particles. Calcium stearate and magnesium stearate provide similar functions. In embodiments, a commercially available zinc stearate known as Zinc Stearate L, obtained from Ferro Corporation, can be used. The external surface additives can be used with or without a coating.

In embodiments, the toners contain from, for example, about 0.1 to about 5 weight percent titania, about 0.1 to about 8 weight percent silica and about 0.1 to about 4 weight percent zinc stearate.

The toner particles of the disclosure can optionally be formulated into a developer composition by mixing the toner particles with carrier particles. Illustrative examples of carrier particles that can be selected for mixing with the toner composition prepared in accordance with the present disclosure include those particles that are capable of triboelectrically obtaining a charge of opposite polarity to that of the toner particles. Accordingly, in one embodiment the carrier particles may be selected so as to be of a negative polarity in order that the toner particles that are positively charged will adhere to and surround the carrier particles. Illustrative examples of such carrier particles include iron, iron alloys, steel, nickel, iron ferrites, including ferrites that incorporate strontium, magnesium, manganese, copper, zinc, and the like, magnetites, and the like. Additionally, there can be selected as carrier particles nickel berry carriers as disclosed in U.S. Pat. No. 3,847,604, the entire disclosure of which is totally incorporated herein by reference, comprised of nodular carrier beads of nickel, characterized by surfaces of reoccurring recesses and protrusions thereby providing particles with a relatively large external area. Other carriers are disclosed in U.S. Pat. Nos. 4,937,166 and 4,935,326, the disclosures of which are totally incorporated herein by reference.

The selected carrier particles can be used with or without a coating, the coating generally being comprised of acrylic and methacrylic polymers, such as methyl methacrylate, acrylic and methacrylic copolymers with fluoropolymers or with monoalkyl or dialkylamines, fluoropolymers, polyolefins, polystyrenes, such as polyvinylidene fluoride resins, terpolymers of styrene, methyl methacrylate, and a silane, such as triethoxy silane, tetrafluoroethylenes, other known coatings and the like.

The carrier particles can be mixed with the toner particles in various suitable combinations. The toner concentration is usually about 2 to about 10 percent by weight of toner and about 90 to about 98 percent by weight of carrier. However, different toner and carrier percentages may be used to achieve a developer composition with desired characteristics.

Toners of the present disclosure can be used in electrostatographic (including electrophotographic) imaging methods. Thus for example, the toners or developers of the disclosure can be charged, such as triboelectrically, and applied to an oppositely charged latent image on an imaging member such as a photoreceptor or ionographic receiver. The resultant toner image can then be transferred, either directly or via an intermediate transport member, to a support such as paper or a transparency sheet. The toner image can then be fused to the support by application of heat and/or pressure, for example with a heated fuser roll.

Depending upon the properties of the toner composition, it can be applied to an imaging substrate in different manners. For example, where the toner composition is a colored toner, it can be applied to an imaging substrate according to conventional development processes as the sole toner used in the imaging process. In other embodiments, such as where the toner composition is a colorless toner used as an overcoating layer, then the toner composition can be applied to an already printed document, such as a document that has already been imaged and optionally fused in a development apparatus.

In embodiments, the fusing of the toner image can be conducted by any conventional means, such as combined heat and pressure fusing such as by the use of heated pressure rollers. The fusing step can be further modified to include an irradiation step, such as an ultraviolet irradiation step, for activating the photo initiator and causing crosslinking or curing of the unsaturated polymer contained in the toner composition. This irradiation step can be conducted, for example, in the same fusing housing and/or step where conventional fusing is conducted, or it can be conducted in a separate irradiation fusing mechanism and/or step.

For example, in one embodiment, the irradiation can be conducted in the same fusing housing and/or step where conventional fusing is conducted. In this embodiment, the irradiation fusing can be conducted substantially simultaneously with conventional fusing, such as be locating an irradiation source immediately before or immediately after a heated pressure roll assembly. Desirably, such irradiation is located immediately after the heated pressure roll assembly, such that crosslinking occurs in the already fused image.

In another embodiment, the irradiation can be conducted in a separate fusing housing and/or step from a conventional fusing housing and/or step. In this embodiment, for example, the irradiation fusing can be conducted in a separate housing from the conventional such as heated pressure roll fusing. That is, the conventionally fused image can be transported to another development device, or another component within the same development device, to conduct the irradiation fusing. In this manner, the irradiation fusing can be conducted as an optional step, for example to irradiation cure images that require improved high temperature document offset properties, but not to irradiation cure images that do not require such improved high temperature document offset properties. The conventional fusing step thus provides acceptable fixed image properties for moist applications, while the optional irradiation curing can be conducted for images that may be exposed to more rigorous or higher temperature environments.

In still another embodiment, the toner image can be fused by irradiation and heat, optionally without conventional pressure fusing. Thus, for example, the image can be fused by irradiation such as by ultraviolet light, in a heated environment such as from about 80 to about 250° C., such as from about 100 to about 225° C. or from about 125 or about 150 to about 180 or about 190° C.

When the irradiation fusing is applied to the photo initiator-containing toner composition, the resultant fused image is provided with non document offset properties, that is, the image does not exhibit document offset, at temperature up to about 80° C., such as up to about 85° C. or up to about 90° C. The resultant fused image also exhibits improved abrasion resistance and scratch resistance as compared to conventional fused toner images. Such improved abrasion and scratch resistance is beneficial, for example, for use in producing book covers, mailers, and other applications where abrasion and scratches would reduce the visual appearance of the item. Improved resistance to solvents is also provided, which is also beneficial for such uses as mailers, and the like. These properties are particularly helpful, for example, for images that must withstand higher temperature environments, such as automobile manuals that typically are exposed to high temperatures in glove compartments or printed packaging materials that must withstand heat sealing treatments.

The irradiation fusing can be conducted by any suitable irradiation device, and under suitable parameters, to cause the desired degree of crosslinking of the unsaturated polymer. For example, in embodiments, the energy source used to initiate crosslinking of the photo initiator and polymer can be actinic, such as radiation having a wavelength in the ultraviolet or visible region of the spectrum, accelerated particles, such as electron beam radiation, thermal such as heat or infrared radiation, or the like. In embodiments, the energy is actinic radiation because such energy provides excellent control over the initiation and rate of crosslinking. Suitable sources of actinic radiation include, but are not limited to, mercury lamps, xenon lamps, carbon arc lamps, tungsten filament lamps, lasers, sunlight, and the like.

Ultraviolet radiation, especially from a medium pressure mercury lamp with a high speed conveyor under UV light, such as about 20 to about 70 m/min., can be used in embodiments, wherein the UV radiation is provided at a wavelength of about 200 to about 500 nm for about less than one second, although the disclosure is not limited thereto. In embodiments, the speed of the high speed conveyor can be about 15 to about 35 m/min. under UV light at a wavelength of about 200 to about 500 nm for about 10 to about 50 milliseconds (ms). The emission spectrum of the UV light source generally overlaps the absorption spectrum of the UV-initiator. Optional curing equipment includes, but is not limited to, a reflector to focus or diffuse the UV light, and a cooling system to remove heat from the UV light source. Of course, these parameters are exemplary only, and the embodiments are not limited thereto. Further, variations in the process can include such modifications as light source wavelengths, optional preheating, alternative photo initiators including use of multiple photo initiators, and the like.

It will also be understood that the irradiation parameters, such as time and power, can also be adjusted to provide desired results. For example, in embodiments, irradiation with ultraviolet light having an output of about 0.1 to about 100 Watts/cm$^2$, for a period of time of from about 0.01 to about 10 seconds, can provide adequate results. For example, an output of from about 1 to about 50 Watts/cm$^2$, such as about 5 Watts/cm$^2$, for a period of time of from about 0.1 to about 5 seconds such as about 0.5 to about 2 seconds, or about 1 second, can provide the desired crosslinking effect. In an embodiment, a total delivered energy of from about 10 to about 200 mJ/cm$^2$, such as about 25 to about 75 mJ/cm$^2$, or about 50 mJ/cm$^2$, provides acceptable results. Of course, amounts outside of these ranges can be used, if desired. For example, less ultraviolet exposure may be necessary, particularly in embodiments where the curing is conducted at an elevated temperature above ambient room temperature.

It is envisioned that the toners of the present disclosure may be used in any suitable procedure for forming an image with a toner, including in applications other than xerographic applications.

An example is set forth herein below and is illustrative of different compositions and conditions that can be utilized in practicing the disclosure. All proportions are by weight unless otherwise indicated. It will be apparent, however, that the disclosure can be practiced with many types of compositions and can have many different uses in accordance with the disclosure above and as pointed out hereinafter.

EXAMPLES

Comparative Example 1

Clear Toner, No Photo Initiator

Into a 2 liter glass reactor equipped with an overhead stirrer and heating mantle was added 183.25 grams amorphous resin emulsion (XP777, a propoxylated bisphenol A fumarate resin, Resapol from Reichold) (45.84 percent by weight) and 104.03 grams unsaturated CPE resin emulsion (UCPE, 16.15 percent by weight). 41.82 grams of $Al_2(SO_4)_3$ solution (1 percent by weight) was added as flocculent under homogenization. The mixture was subsequently heated to 46.2° C. for aggregation at 300 rpm. The particle size was monitored with a Coulter Counter until the core particles reached a volume average particle size of 4.59 microns with a GSD of 1.25, and then 85.52 grams of the above XP777 resin emulsion was added as shell, resulting in a core-shell structured particles with an average particle size of 6.48 microns, GSD 1.23. Thereafter, the pH of the reaction slurry was increased to 7.2 using 1.615 grams EDTA (39 percent by weight) and NaOH (4 percent by weight) to freeze the toner growth. After freezing, the reaction mixture was heated to 69.9° C., and pH was reduced to 5.97 for coalescence. The toner was quenched after coalescence, and it has a final particle size of 5.90 microns, GSD of 1.25, and Circularity of 0.960. The toner slurry was then cooled to room temperature, separated by sieving (25 micron), filtration, followed by washing and freeze dried.

Comparative Example 2

Irgacure 819 Photo Initiator in Toner a. Preparation of XP777 Emulsion Containing 4 Percent by Weight Irgacure 819 Photo Initiator 220 grams of XP777 resin and 9.167 grams photo initiator Irgacure 819 were measured into a 2 liter beaker containing about 2000 grams of ethyl acetate. The mixture was stirred at about 300 revolutions per minute at room temperature to dissolve the resin and IR absorber in the ethyl acetate. 4.69 grams of sodium bicarbonate was measured into a 4 liter Pyrex glass flask reactor containing about 1700 grams of deionized water. Homogenization of the water solution in the 4 liter glass flask reactor was commenced with an IKA Ultra Turrax T50 homogenizer at 4,000 revolutions per minute. The resin solution was then slowly poured into the water solution as the mixture continued to be homogenized, the homogenizer speed was increased to 8,000 revolutions per minute and homogenization was carried out at these conditions for about 30 minutes. Upon completion of homogenization, the glass flask reactor and its contents were placed in a heating mantle and connected to a distillation device. The mixture was stirred at about 200 revolutions per minute and the temperature of said mixture was increased to 80° C. at about 1° C. per minute to distill off the ethyl acetate from the mixture. Stirring of the said mixture was continued at 80° C. for about 180 minutes followed by cooling at about 2° C. per minute to room temperature. The product was screened through a 25 micron sieve. The resulting resin emulsion was comprised of about 30.00 per cent by weight solids in water.

b. Preparation of Toner Containing Irgacure 819 Photo Initiator

Into a 2 liter glass reactor equipped with an overhead stirrer and heating mantle was added 240 grams above emulsion containing XP777 resin and Irgacure 819, and 89.11 grams unsaturated CPE resin emulsion (UCPE, 16.16 percent by weight). 35.84 grams of $Al_2(SO_4)_3$ solution (1 percent by weight) was added as flocculent under homogenization. The mixture was subsequently heated to 44° C. for aggregation at 300 rpm. The particle size was monitored with a Coulter Counter until the core particles reached a volume average particle size of 4.68 microns with a GSD of 1.25, and then 112 grams of the above XP777 and Irgacure 819 emulsion was added as shell, resulting in a core-shell structured particles with an average particle size of 5.71 microns, GSD 1.25. Thereafter, the pH of the reaction slurry was then increased to 7.4 using 1.39 grams EDTA (39 percent by weight and NaOH (4 percent by weight) to freeze the toner growth. After freezing, the reaction mixture was heated to 69.4° C., and pH was reduced to 5.97 for coalescence. The toner was quenched after coalescence, and it has a final particle size of 5.90 microns, GSD of 1.27, and Circularity of 0.981. The toner slurry was then cooled to room temperature, separated by sieving (25 micron), filtration, followed by washing and freeze dried.

Example 1

ESACURE® ONE Photo Initiator in Toner a. Preparation of XP777 Emulsion Containing 4 Percent by Weight ESACURE® ONE Photo-Initiator This emulsion was prepared following the same procedure as Comparative Example 2 above, except 4 wt % of the photo-initiator ESACURE® ONE was used.

b. Preparation of Toner Containing ESACURE® ONE Photo-Initiator

Into a 2 liter glass reactor equipped with an overhead stirrer and heating mantle was added 446.65 grams above emulsion (16.12 percent by weight) containing XP777 resin and ESACURE® ONE photo-initiator, and 48.96 grams unsaturated CPE resin emulsion (UCPE, 29.41 percent by weight). 35.84 grams of $Al_2(SO_4)_3$ solution (1 percent by weight) was added as flocculent under homogenization. The mixture was subsequently heated to 37.2° C. for aggregation at 200 rpm. The particle size was monitored with a Coulter Counter until the core particles reached a volume average particle size of 5.54 microns with a GSD of 1.20, and then 208.44 grams of the above XP777 and photo-initiator ESACURE® ONE emulsion was added as shell, resulting in a core-shell structured particles with an average particle size of 6.75 microns, GSD 1.24. Thereafter, the pH of the reaction slurry was then increased to 6.95 using 1.39 grams EDTA (39 percent by weight) and NaOH (4 percent by weight) to freeze the toner growth. After freezing, the reaction mixture was heated to 69.4° C., and pH was reduced to 6.00 for coalescence. The toner was quenched after coalescence, and it has a final particle size of 6.75 microns, GSD of 1.24, and Circularity of 0.980. The toner slurry was then cooled to room temperature, separated by sieving (25 μm), filtration, followed by washing and freeze dried.

Comparative Testing

UV-Vis-NIR spectra were obtained for each of the amorphous binder resin XP777 alone, a mixture of amorphous binder resin XP777 and crystalline binder resin UCPE, a co-emulsified XP777 resin with Irgacure 819 (comparative Example 1), and a co-emulsified XP777 resin with ESACURE® ONE (Example 1). The results show that upon addition of the UV-initiators, absorption of XP777 in the UV region was improved in both cases, although the absorption was more pronounced with the use of ESACURE® ONE.

Glass transition temperatures (Tg's) obtained of emulsions prepared by co-emulsifying XP777 with two different photo-initiators are listed in Table 1. Table 1 shows that Irgacure 819 depressed the Tg of XP777, while the ESACURE® ONE did not, which indicated that the heat cohesion property of the resultant toner will be maintained, if not improved.

TABLE 1

| Initiator | Tg of dried emulsion |
|---|---|
| XP777 resin | 57.29° C. |
| Emulsion Irgacure 819 (comparative example 2) | 54.01° C. |
| Emulsion with ESACURE ® One (Example 1) | 59.11° C. |

Document offset of the toners in the above experiments were measured to determine their curing performance under UV light. The results are shown in Table 2. The results show that both UV photo initiators demonstrate good UV curing performance.

TABLE 2

| Toner | UV | Toner-Toner (SIR) | Toner-Paper (SIR) |
|---|---|---|---|
| Example 1 | 4 pph ESACURE ® One (Core/shell) | 4.5 | 5.0 |
| Comp. Ex. 2 | 4 pph Irgacure 819 (Core/shell) | 4.5 | 5.0 |
| Comp. Ex. 1 | No photo-initiator | 0 | 0 |

The color difference for the toners was also evaluated. The ideal UV photo-initiator would be colorless so that it dose not affect the yellow, magenta and cyan colors of the toners. Delta E 2000 with reference to the substrate (DCEG, 120 gsm coated paper) was measured at TMA=0.5 mg/cm2. Table 3 shows the difference in color (ΔE2000) relative to the sample without photo-initiator. The general target is to have a minimal color shift for clear particles that contain a photo-initiator so that when the pigments are incorporated into the particles, the color does not change.

TABLE 3

| Toner | Photo-initiator | ΔE2000 (relative to Comp. Ex. 1) |
|---|---|---|
| Comp. Ex. 1 | none | 1.6 |
| Example 1 | ESACURE ® ONE | 1.0 |
| Comp. Ex. 2 | Irgacure 819 | 4.0 |

The data in Table 3 shows that the conventional photo-initiator (Irgacure 819) has a delta E2000 value greater than 3, which indicated that with incorporation at 4 percent by weight of Irgacure 819 in clear toner particles, a difference in color was apparent to the eye. ESACURE® ONE is nearly colorless at the same content.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. An emulsion aggregation toner composition comprising toner particles comprising:

an amorphous polyester resin;

an optional crystalline resin;

an optional colorant;

an optional wax;

an optional coagulant; and a polymeric or oligomeric hydroxy ketone photo initiator capable of initiating crosslinking of said polyester resin, wherein at least one of the amorphous polyester resin and the optional crystalline resin when present is unsaturated, and the toner particles have a core-shell structure.

2. The toner composition of claim 1, wherein the polyester resin is an unsaturated amorphous polyester resin selected from the group consisting of copoly (butylene-terephthalate)-copoly(butylene-fumarate), copoly(butylene-terephthalate)-copoly(butylene-fumarate), copoly(propylene-terephthalate)-copoly(propylene-fumarate), poly(propoxylated bisphenol-A-fumarate), poly(ethoxylated bisphenol-A fumarate), poly(propoxylated bisphenol-A co-itaconate), poly (ethoxylated bisphenol-A co-itaconate), poly(propoxylated bisphenol-fumarate), poly(propoxylated bisphenol-succinate), poly(propoxylated bisphenol-adipate), poly(propoxylated bisphenol-glutarate), sulfonated forms of the preceding resins, and mixtures thereof.

3. The toner composition of claim 1, wherein the crystalline polyester resin is present and is selected from the group consisting of poly(ethylene-adipate), poly(propylene-adipate), poly(butylene-adipate), poly(pentylene-adipate), poly (hexylene-adipate), poly(octylene-adipate), polyethylene-succinate), poly(propylene-succinate), polybutylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), copoly(5-sulfoisophthaloyl)-copoly(ethylene-adipate), copoly(5-sulfoisophthaloyl)-copoly(propylene-adipate), copoly(5-sulfoisophthaloyl)-copoly(butylene-adipate), copoly(5-sulfo-isophthaloyl)-copoly(pentylene-adipate), copoly(5-sulfo-isophthaloyl)-copoly(hexylene-adipate), copoly (ethylene-sebacate)-copoly(ethylene-fumarate), copoly (ethylene-dodecanoate)-copoly(ethylene-fumarate), copoly (nonylene-sebacate)-copoly(nonylene-fumarate), copoly (nonylene-dodecanoate)-copoly(nonylene-fumarate), copoly(decylene-sebacate)-copoly(decylene-fumarate), copoly(decylene-dodecanoate)-copoly(decylene-fumarate), copoly(butylene-fumarate)-copoly(hexylene-fumarate), and mixtures thereof.

4. The toner composition of claim 1, wherein the polymeric or oligomeric hydroxyl ketone photo initiator does not depress the Tg of the amorphous resin.

5. The toner composition of claim 1, wherein the polymeric or oligomeric hydroxyl ketone photo initiator is colorless.

6. The toner composition of claim 1, wherein the toner particle comprises a mixture of one or more amorphous resins and one or more crystalline resins, wherein the amorphous resin and the optional crystalline resin has an acid number of from about 0 to about 40 mg KOH/g.

7. The toner composition of claim 6, wherein the toner particle comprises:

an amorphous resin having an onset glass transition temperature of from about 40° C. to about 80° C., and a crystalline resin having a melting point of from about 30° C. to about 120° C.

8. The toner composition of claim 1, wherein the polymeric or oligomeric hydroxy ketone photo initiator is an ultraviolet photo initiator.

9. The toner composition of claim 1, wherein the polymeric or oligomeric hydroxy ketone photo initiator is a compound of the formula

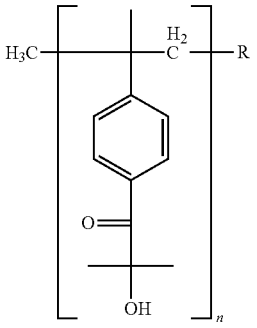

wherein R is H, $CH_3$ or an alkyl radical represented by $C_nH_{2n+1}$ in which n is a positive integer from 2 to about 1000.

10. The toner composition of claim 1, further comprising a second photo initiator different from the polymeric or oligomeric hydroxy ketone photo initiator.

11. The toner composition of claim 1, comprising polyester resin in an amount of, from about 70 to about 99 wt % and photo initiator in an amount of from about 0.1 to about 15 wt %, each by weight of the toner particles on a dry weight basis and exclusive of any optional external additives.

12. The toner composition of claim 1, wherein the wax is present, is a polyethylene wax, a polypropylene wax, or mixtures thereof, and is present in an amount of about 5% to about 15% by weight based upon the total weight of the composition.

13. The toner composition of claim 1, wherein the colorant is present and comprises a pigment, a dye, or mixtures thereof, and is present in an amount of about 1% to about 25% by weight based upon the total weight of the composition.

14. The toner composition of claim 1, wherein the colorant is not present, and the toner composition is clear and colorless.

15. The toner composition of claim 1, wherein the photo initiator is capable of initiating crosslinking of said polyester resin when exposed to ultraviolet light from a source having an output of from about 1 to about 100 Watts/$cm^2$ for a period of time of from about 0.01 to about 10 seconds.

16. A method of developing an image, comprising:

applying the toner composition of claim 1 to a substrate; and fusing the toner composition to the substrate by exposing said toner composition to an irradiation source that initiates crosslinking of said polyester resin.

17. The method of claim 16, wherein said fusing comprises subjecting said toner composition to an irradiation source having an output of from about 0.1 to about 100 Watts/$cm^2$ for a period of time of from about 0.01 to about 10 seconds, and at a temperature of from about 80 to about 250° C.

18. The method of claim 16, wherein said toner composition is a colorless toner composition and is applied over a colored toner composition that does not include a photo initiator, and said colored toner composition is fused in a separate step under at least one of heat and pressure.

19. The method of claim 16, wherein said toner composition is a colored toner composition and is applied in imagewise fashion to said substrate.

20. A emulsion aggregation process for preparing a toner, comprising:

(i) emulsifying a polyester resin and a photo initiator, wherein the polyester resin comprises an amorphous resin and optionally a crystalline resin, at least one of the amorphous polyester resin and the optional crystalline resin when present is unsaturated, and the photo initiator is a polymeric or oligomeric hydroxyl ketone photo initiator;

(ii) adding thereto a colorant dispersion, optionally a wax dispersion, and surfactant;

(iii) adding thereto a coagulant to form a mixture, with homogenization of from about 2,000 to about 10,000 rpm, and optionally adjusting a pH of the mixture from about 7 to about 2.5, and thereby generating an aggregate mixture comprising aggregated composites of from about 1 to about 4 microns in diameter;

(iv) heating the aggregate mixture to a temperature of from about 30 to about 50° C. to generate aggregate composites with a particle size of from about 3 to about 11 microns in diameter;

(v) forming a shell over the aggregate composites to form a toner composite;

(vi) adjusting the pH to about 6 to about 9 to freeze the toner composite particle size, and optionally adding a metal sequestering agent;

(vii) heating the aggregate composites to a temperature of from about 63 to about 90° C., and optionally adjusting the pH to about 8 to about 5.5, to result in coalesced toner particles having a core-shell structure; and (vii) optionally washing and drying the toner particles.

* * * * *